United States Patent [19]

Hjort et al.

[11] Patent Number: 4,779,990

[45] Date of Patent: Oct. 25, 1988

[54] IMPELLER APPARATUS

[76] Inventors: Sven Hjort, Skiftesvägen 113; Börje Skånberg, Milstensvägen 16, both of S-183 38 Täby, Sweden

[21] Appl. No.: 933,134

[22] Filed: Nov. 21, 1986

[30] Foreign Application Priority Data

Nov. 21, 1985 [SE] Sweden ..... 8505508

[51] Int. Cl.[4] ..... B01F 3/04; B01F 7/18; B01F 7/26; F01D 5/14

[52] U.S. Cl. ..... 366/102; 261/93; 366/279; 366/325; 366/343; 416/197 R; 416/243

[58] Field of Search ..... 366/101-104, 366/241, 279, 325, 330, 343; 416/197 R, 223 R, 243; 261/93, 87, 84

[56] References Cited

U.S. PATENT DOCUMENTS

| | | | |
|---|---|---|---|
| 4,193 | 9/1845 | Phleger | 416/243 X |
| 525,095 | 8/1894 | Detwiler | 366/104 |
| 573,993 | 12/1896 | McCallen | 416/197 |
| 636,400 | 11/1899 | Friedman | 416/243 X |
| 858,635 | 7/1907 | St. Croix | 416/197 |
| 1,019,078 | 3/1912 | Olmsted | 416/243 X |
| 2,966,345 | 12/1960 | Burgoon et al. | 366/102 X |
| 4,519,715 | 5/1985 | Golobic et al. | 366/343 |

FOREIGN PATENT DOCUMENTS

| | | | |
|---|---|---|---|
| 123731 | 7/1931 | Austria | 416/243 |

*Primary Examiner*—John Petrakes

*Attorney, Agent, or Firm*—Burns, Doane, Swecker & Mathis

[57] ABSTRACT

An impeller apparatus for dispersing a gas into a liquid in a vessel includes a centrifugal flow turbine, the blades (621) of which are formed with a substantially streamlined trailing surface terminated by a sharply pronounced spine (63). The blade is formed by a plate-like initial blank being cut to a shape having a central line of symmetry, the blank then being folded along the straight line of symmetry.

20 Claims, 3 Drawing Sheets

IMPELLER APPARATUS

TECHNICAL FIELD

An impeller apparatus for agitating a liquid and possibly a gas in a vessel, including an impeller and a rotatable shaft carrying the propeller for rotation about the axis of the shaft in the liquid, the impeller including at least two blades which have their leading surfaces in the direction of rotation formed for generating an outwardly directed, radial liquid flow. The apparatus may be used for mixing liquids, and particularly but not exclusively, for dispersing gases into the liquid contained in the vessel.

BACKGROUND ART

The conventional method of dispersing gases into a liquid is to use a mixing apparatus including a vessel for the liquid, a rotating radial flow impeller immersed in the liquid with its axis vertically oriented, and a gas distribution jet or header in the vessel under the impeller. The impeller or radial flow turbine thus disperses the gas introduced into the liquid via the gas jet means. When the blades of the turbine are rotated in the liquid, the hydrostatic pressure in front of the blades increases and decreases behind the blades. This is a natural consequence of the hdyrodynamic resistance which, together with the centrifugal and Coriolis forces urge the fluid in a radial direction. However, the pressure difference results in that the gas bubbles move to the low pressure areas behind the blades, where they collect and combine into larger gas cavities. In practice, these cavities result in a streamline forming of the blades, which signifies a drastic reduction of the hydrodynamic resistance, and thus also a drastic reduction of the power required to rotate the turbine. In order to retain a desired degree of agitation, it is therefore necessary to install a very much greater and thus more costly agitator than would otherwise be required. In addition, dispersion of the gas in the liquid is made more difficult by the mentioned coalescing of the gas bubbles and the formation of larger gas volumes on the trailing sides of the blades.

The case may also be conceived where a liquid that is to be mixed contains dissolved gases which it is desired to remain dissolved in the liquid. It may then happen that these gases depart from the liquid due to the low pressure regions behind the blades, forming gas cavities behind the blades, and gradually departing from the liquid in the form of large gas bubbles. The pressure on the trailing surfaces of the blades may also be so low that the liquid is vapourized and the genreated vapour forms the mentioned gas cavities so that in practice these cavities drastically reduce the driving power of the turbine.

A first object of the invention is therefore to provide a blade configuration for a turbine or impeller of the indicated kind, such that the driving power of the impeller does not fall due to the occurrence of such gas cavities on the trailing sides of the blades during operation of the apparatus, particularly in connection with the dispersion of gas into the liquid.

SUMMARY OF THE INVENTION

The present invention is essentially distinguished in that the trailing sides of the blades are streamlined. As mentioned above, the liquid is agitated by a combination of high and low hydrostatic pressures inside the liquid. This is analogous with the situation ground the wings of an aircraft, as well as other aero- and hydrofoils. By filling, in accordance with the invention, the low pressure region behind the blades with structural material, where this region could otherwise be filled with gas when the blades conventionally have a flat trailing surface, these regions are no longer available for the formation of large gas cavities. Accordingly, in the invention the trailing side of each blade is physically streamlined, and in the case of dispersion of gas in the liquid, this signifies that the quotient between the turbine starting power and operational power is substantially constant in relation to the quotient $Q/ND^3$, where Q denotes the gas flow, N the rotational speed of the turbine and D the turbine diameter, in the normally utilized quotient interval.

In mixing apparatus of the type in question, the blades may be formed by straight elements, the effective, straight, leading surface of which is adapted such that the blades are oriented in an interval defined by the effective leading surface of the blade being swept backwards in the direction of rotation of 45° from the radial direction, and by the effective leading surface of the blade extends radially. Since the impeller or turbine blades are adapted to produce a substantially pure radial flow, they may have a leading surface which is symmetrical in relation to the plane of rotation of the blades. Accordingly, the blades may have a flat leading surface, or it may be of a concave configuration. In order that the trailing surface of the blades may be regarded as streamlined, the trailing side of the blade should have a sharp edge defining the portion of the trailing side of the blade situated furthest from its leading side. The trailing side of the blade can be generally regarded as having a cross section in the form of an equilateral triangle, the base sides of which define the edge lines of the leading surface of the blade. The "triangle legs" merging together into said edge may optionally be straight, but are preferably symmetrically curved, their concave sides facing towards each other. The blades may be formed from sectors of straight, circular or tapering tubes, these sectors being folded along a central line to be given the mentioned sharp edge. In accordance with the invention, it is thus not sufficient to form the trailing side of the blade from a sector of a circular-cylindrical tube without symmetrically folding this sector.

The blades in accordance with the invention may have the form of a generally V-shaped plate, the concave side of which may be filled or closed off by structural material. Preferably, the blades are formed with a leading surface, the longest dimension of which, i.e. length dimension, extends radially, and of which the width dimension is constant or tapering radially outwards.

The invention will now be described in detail with the aid of an unrestricting example and with reference to the accompanying drawing.

DESCRIPTION OF THE PREFERRED EMBODIMENTS

Figure 1:
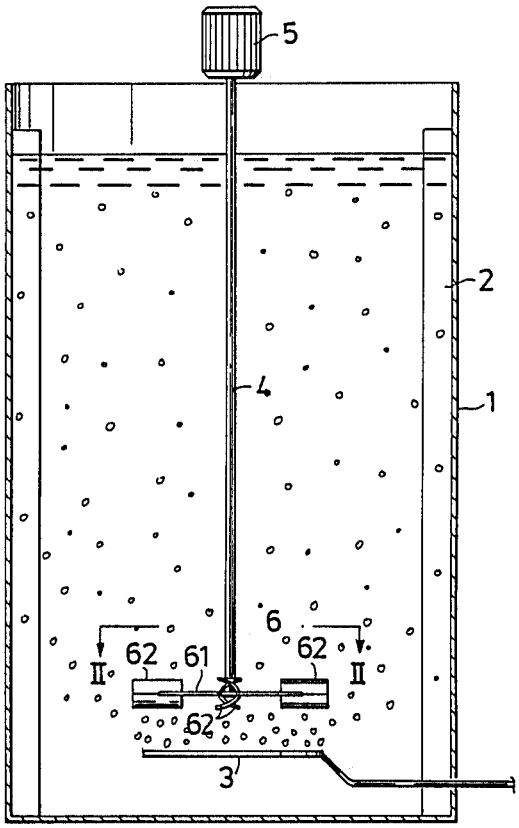
FIG. 1 schematically illustrates an agitating apparatus for dispersing gas into a liquid.
Figure 2:
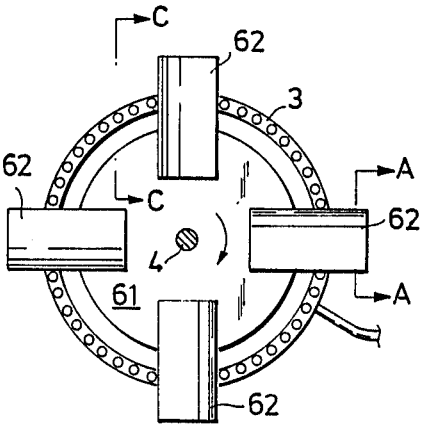
FIG. 2 is a section taken along the line II—II in FIG. 1.
Figure 3:
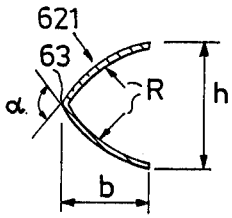
FIG. 3 is a section through a first embodiment of an impeller blade in the apparatus, taken along the line A—A in FIG. 2.
Figure 4:
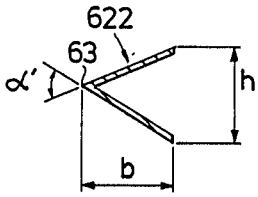
FIG. 4 is a section corresponding to the one on FIG. 3 of another inventive blade.
Figure 5:
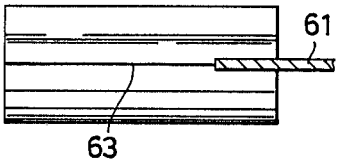
FIG. 5 is a section along the line C—C in FIG. 2 of a blade according to FIGS. 3 or 4.

FIG. 1 schematically illustrates a cylindrical, open vessel 1, the wall of which is provided with vertical baffles 2 for preventing rotation of the liquid in the vessel. In the bottom region of the vessel there is an annular jet means 3, with the aid of which a cylindrical gas bubble curtain is introduced into the liquid. A vertical shaft 4 is arranged coaxial with the means 3 and is mounted for rotation with the aid of a drive unit 5. The bottom end of the shaft 4 carries a disc 61 coaxially mounted above the jet means 3. In accordance with the invention, the disc 61 has blades 62 in its edge region. FIGS. 2 and 5 illustrate a first type of inventive blade, which has a substantially constant height along its radial extension. FIG. 3 illustrates a first cross-sectional configuration of this blade, and it will be seen that the blade 621 comprises a segment of a circularcylindrical tube with the radius R, this segment being taken along tube generatrices and is folded along a central generatrix to form a spine 63. The blade is preferably slit at one end along the spine 63 for conventionally enabling fitting onto the disc 61. The blade 621 has a width b wich is greater than half its height h. The convex surface of the blade 621 forms the trailing surface of the blade and its concave surface is its leading surface. The blade 621 is mounted on the disc 61 so that the spine 63 extends radially or with a backward sweep of at most 45°. Since the blade 621 has a sharply defined spine 63, no notable gas cavities occur behind the blade during operation. By the generally V-shaped blade being formed on from a tubular blank, its trailing side has a particularly favourable streamline configuration. FIG. 4 illustrates an alternative blade cross-section for the blade configuration apparent from FIGS. 2 and 5. The blade 622 according to FIG. 4 is formed from a flat trapezoidal plate blank, which is folded along a line of symmetry so that a sharp, straight spine 63 is formed, and so that the height h of the blade will be less than its width b. As with the embodiment according to FIG. 3, the spine 63 and the relationship b greater than h/2 ensure that the blade is given a streamlined configuration suitable to the purpose, so that no gas cavities can be formed behind the blade during operation. The apex angle $\alpha$ in FIG. 3 is thus less than 180°, and the apex angle $\alpha'$ in FIG. 4 is less than 60°.

Figure 6:
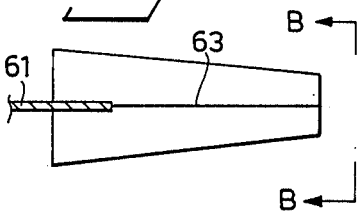
FIG. 6 is a view of an alternatvie inventive blade configuration.

An impeller apparatus of the radial flow type in question here, it may be to the purpose to allow the height of the blades to decrease radially outwards. FIG. 6 schematically illustrates such a blade type. In this case the blade 623 according to FIG. 8 may be formed from a sector of a circular-cylindrical tube blank, the sector being formed by the tube being cut along a plane forming an angle to the axis of the blank, the sector thus produced being folded along central generatrix to form a sharp spine 63 so that the cross-sectional configuration of the blade 623 corresponds to the one for the blade 621 in FIG. 3. Alternatively, the blade may be formed by a tapering tubular blank with a circular cross section, a segment of the tapering tube being cut out, e.g. along two generatrices, after which the generally trapezoidal segment is folded along a central generatrix which is a line of symmetry of the segment, to form a sharp spine 63 on the blade 624 according to FIG. 7. The cross-sectional configuration of the blade according to FIG. 7 corresponds to the one according to FIG. 3. The blade embodiment according to FIGS. 6 and 9 is formed by a flat trapezoidal plate blank being folded along a line of symmetry to form a sharp spine 63, the cross-sectional configuration of the blade 625 according to FIG. 9 then corresponding to the one according to FIG. 4.

Figure 7:
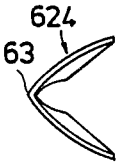
FIG. 7 is a view taken along the line B—B in FIG. 6, to illustrate a first cross-sectional configuration of such a blade.
Figure 8:
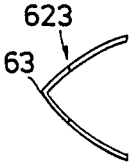
FIG. 8 is a second cross-sectional configuration, along the line B—B in FIG. 6.
Figure 9:
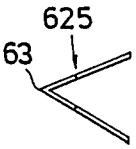
FIG. 9 is a cross-section along the line B—B in FIG. 6 of a third variation of blade cross-sectional configuration.

In the embodiments according to FIGS. 7, 8 and 9, the long edge of the blade is in one plane which is parallel to the axial direction of the impeller when the blade is fitted. The blades according to FIGS. 4, 7, 8 and 9 are also preferably slit at one edge along the spine 63 for permitting easy fitting to the edge of the disc 61. The blades according to FIGS. 3, 4, 7, 8 and 9 can be used in the illustrated form, since they are symmetrical in relation to a plane through the spine 63, so that when the blades are fitted to generate a pure radial flow, both long edges of the blades are in a plane parallel to the impeller shaft. In the blade embodiments apparent from FIGS. 3, 4, 7, 8, 9, i.e. blades with a concave leading side, a high pressure region is formed on their leading sides, so that the flow picture in cross-section through the longitudinal direction of the blades is substantially the same as if the concave leading sides of the blades were filled by structural material.

In the embodiments according to FIGS. 7, 8 and 9, the direction of the spine 63 defiens the radial direction of the blade. However, should the blades according to FIGS. 7, 8 and 9 be filled with structural material on their leading sides, resulting in a flat leading surface in a plane through the long edges of the blades, this surface would define the effective direction of the blades.

Figure 10:
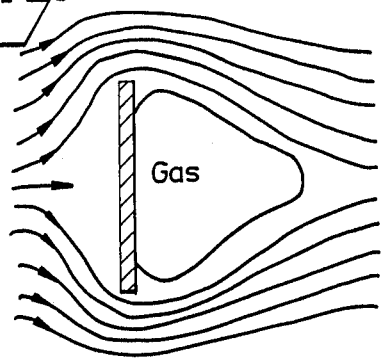
FIG. 10 illustrates the flow conditions around conventional impeller blade.

FIG. 10 schematically illustrates a cross-section through a conventional impeller blade for an apparatus of the kind illustrated in FIGS. 1 and 2 during operation for dispersing a gas into a liquid. It will be seen that a large gas cavity is formed on the trailing side of the blade. The inventive blades eliminate the occurence of such gas cavities by their having been given a trailing side which has substantially the same shape as the gas cavity behind a blade with a falt trailing surface.

Figure 11:
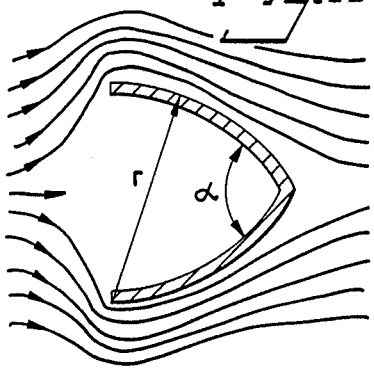
FIG. 11 illustrates the flow conditions around an impeller blade in accordance with the invention, corresponding to the blade in FIG. 3.
Figure 12:
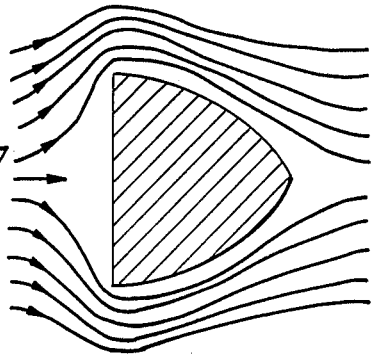
FIG. 12 schematically illustrates a blade in accordance with the invention with a flat leading surface and a homogeneous cross-section.

FIG. 11 illustrates the flow pattern in a cross-section through a blade in accordance with the invention, e.g. a blade according to the FIGS. 3, 7 and 8, and FIG. 12 illustrates the flow picture in a cross section through a corresponding blade having a leading concave side filled with structural material.

Figure 13:
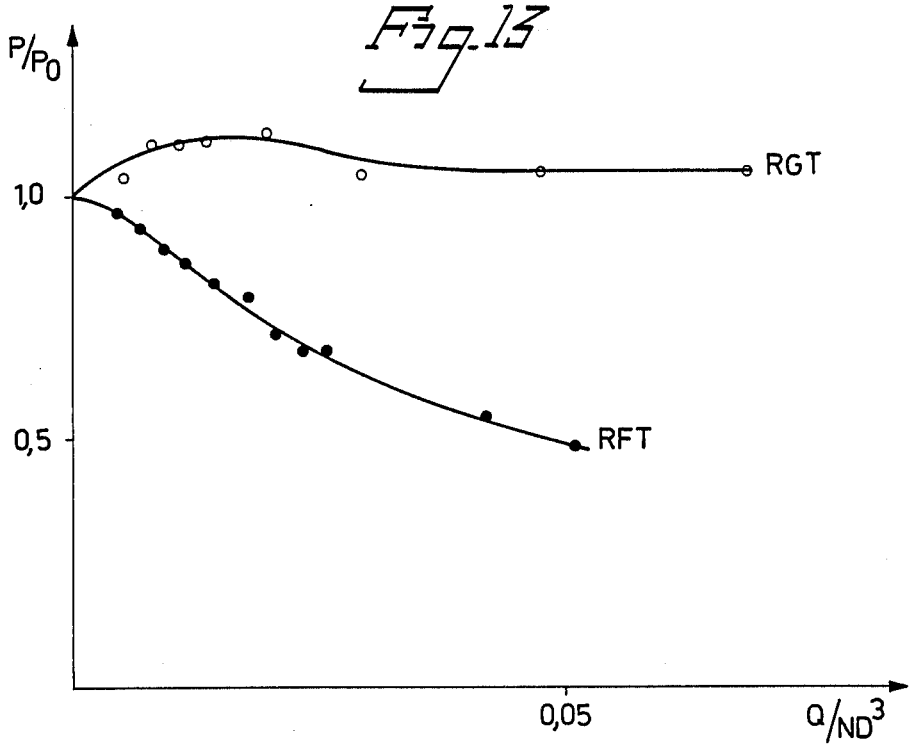
FIG. 13 is a graph illustrating the power variation for impeller drive in response to supplied gas quantity, impeller revolutionary speed and diameter for dispersing gas into a liquid with the aid of an apparatus in accordance with the invention and an apparatus according to the state of the art.

FIG. 13 illustrates the power requirement as a function of the gas flow for a conventional centrifugal turbine and for the inventive centrifugal turbine RGT, as driven for dispersing gas into a liquid in an apparatus generally according to FIGS. 1 and 2. In FIG. 13, $P/P_O$ indicates the driving power/starting power and $Q/ND^3$ the quotient between the gas flow and the product of the turbine revolutionary speed and the cube of the turbine diameter. It will be seen from FIG. 13 that the driving power falls drastically with increasing gas flow for a conventional centrifugal turbine, the blades of which have a flat trailing side, and that the driving power for a centrifugal turbine having inventive blades is substantially constant for varying gas flow within the interesting range for apparatus of the type in question. The results according to FIG. 13 are obtained with a centrifugal turbine having a diameter of 150 mm, a revolutionary spedd of 400 rpm and flat blades, in comparison with an inventive turbine with a diameter of 25 mm, a revolutionary speed of 180 rpm and blades according to FIG. 3 having the angle $\alpha=120°$, $b=h\sqrt{3/2}$ and $R=h$.

In accordance with the invention, a centrifugal flow impeller is achieved having blades which are symmetrical relative to a central plane coinciding with the plane of rotation of the blades. The trailing surface of the blades is terminated by a sharply pronounced spine in the plane of symmetry. The spine has rectilinear extension. The blade may be readily manufactured starting with a flat plate blank, circular-cylindrical tubular blank or a tapering tubular blank with a circular cross-section. The blank has a substantially rectangular or trapezoidal configuration and is folded about a line of symmetry to form a sharp spine. In the case of blanks in the form of sectors of tubular starting material, the blank is folded so that the concave surfaces of the blank halves face each other. In a cross-section through the longitudinal direction of the blades the distance between both free edges of the blade is greater than the extension of the blade in its plane of symmetry. Since the concave side of the blade is the leading side thereof, the hydrostatic pressure will be high, and thus no gas cavity will be generated in the leading surface concavity of the blade. If so desired, this concavity can be filled with structural material up to a surface extending through the free edges of the blade.

In FIG. 3 the angle $\alpha=120°$, $b=h\sqrt{3/2}$ and $R=h$. In FIG. 4 the angle $\alpha'\approx 60°$.

The angle between a line passing through the upper and lower edges of the blade and the trailing blade surface contiguous thereto attains to at least 55° and at most about 90° in a cross-section through the blades, i.e., in the normal plane to the longitudinal direction of the blade. This angle is preferably 90° in the embodiments according to FIGS. 3, 7 and 8. In FIGS. 4 and 9 this angle is about 60°. It should be clear, however, that the embodiments according to FIGS. 4 and 9 may be modified with further folding lines so that the corss-sectional configuration of the trailing surface of the blade approximates the one according to FIG. 3, for example, where the angle may attain to 75° while $\alpha$ remains 60°. Common to all embodiments is that b is preferably equal to, or greater than 0.7 h. In all the blade configurations the contours of the blade trailing edge are decisive for the properties of the apparatus, and the leading side of the blade may be a concave surface which is symmetrical in relation to the plane of symmetry of the trailing blade surface, or a flat surface where the latter may be formed by the leading surface of a plate section defining the trailing surface of the blade is completely or partially filled with a structural material, or by a plain flat plate being connected between the edges of the plate section, and optionally filling in the ends of the resulting hollow section.

Preferably, the longitudinal axis of the blade extends generally radially to the impeller shaft.

Although the blades normally are oriented with their longitudinal axis in a normal plane to the shaft axis, it is appreciated that deviations from such geometry are possible. Thus, the longitudinal axis of the blade could be curved (possibly in a shaft axial plane) and/or form an angle with said normal plane. The surface defined by the blade axis as the impeller rotates could then (adjacent the blade) be considered as the "plane of symmetry" for the blade.

The critical streamlined cross-section is defined by the relative liquid flow direction around the blade. Although only preferred embodiments are specifically illustrated and described herein, it will be appreciated that many modifications and variations of the present invention are possible in light of the above teachings and within the purview of the impended claims without departing the spirit and intended scope of the invention.

We claim:

1. An impeller apparatus for agitating a liquid and dispersing a gas introduced therein in a vessel, the apparatus comprising:

an impeller;

a rotatable vertical shaft carrying the impeller for rotation about an axis of the shaft in said liquid; and means for introducing the gas into the liquid below the impeller;

said impeller comprising a disc perpendicularly mounted on the shaft to be rotated therewith, and at least two turbine blades mounted to the disc at the outer periphery of the disc, each blade having a leading surface and a trailing surface with regard to a direction of rotation of the impeller, each leading surface being formed and oriented for producing a substantially radially outwardly directed liquid flow, and each trailing surface having a substantially streamlined cross section which is substantially symmetrically relative to a plane of movement of an axis of the blade and which has a well-defined spine in said plane.

2. The apparatus as claimed in claim 1, wherein the blade includes a generally V-shaped section, both legs of which are symmetrical in relation to the longitudinal direction of the blade.

3. The apparatus as claimed in claim 2, wherein the blade includes a segment defined by two generatrices, the segment being a circular-cylindrical, straight, tubular element which is sharply folded along the central generatrix of the segment.

4. The apparatus as claimed in claim 3, wherein the blade includes a substantially rectangular or trapezoidal flat plate blank, which is sharply folded about a line of symmetry.

5. The apparatus as claimed in claim 3, wherein the blade includes a substantially rectangular or trapezoidal flat plate blank, which is sharply folded about a line of symmetry.

6. The apparatus as claimed in claim 3, wherein the leading concave surface of the blade is filled with structural material up to a plane through the edges of the blade.

7. The apparatus as claimed in claim 2, wherein the leading concave surface of the blade is filled with structural material up to a plane through the edges of the blade.

8. The apparatus as claimed in claim 2, wherein the blade includes a segment of a straight, circular-cylindrical tubular element formed by cutting the tubular element along a plane forming an angle to the axis of the element, the segment being bent along a central generatrix.

9. The apparatus as claimed in claim 2, wherein the blade is formed by a segment defined by two generatrices, the segment being a tapering circular tubular element, which is sharply folded along a central generatrix.

10. The apparatus as claimed in claim 2, wherein in the normal plane to the longitudinal direction of the blade the distance between the plane of symmetry and the edge of the blade is less than the dimension of the blade in the plane of symmetry.

11. The apparatus as claimed in claim 2, characterized in that in the normal plane to the longitudinal direction of the blade the distance between the plane of symmetry and the edge of the blade is less than the dimension of the blade in the plane of symmetry.

12. The apparatus as claimed in claim 2, wherein the blades are mounted such that their effective leading surfaces in the rotational plane of the impeller are within an interval defined by an impeller radius and a backwardly swept line forming 45° with the radius.

13. The apparatus as claimed in claim 2, further comprising a gas heater mounted to feed gas to the impeller region for dispersing the gas into the liquid.

14. The apparatus as claimed in claim 1, wherein the blade includes a segment of a straight, circular-cylindrical tubular element formed by cutting the tubular element along a plane forming an angle to the axis of the element, the segment being bent along a central generatrix.

15. The apparatus as claimed in claim 14, wherein the blade includes a substantially rectangular or trapezoidal flat plate blank, which is sharply folded about aline of symmetry.

16. The apparatus as claimed in claim 1, wherein the blade is formed by a segment defined by two generatrices, the segment being a tapering circular tubular element, which is sharply folded along a central generatrix.

17. The apparatus as claimed in claim 16, wherein the blade includes a substantially rectangular or trapezoidal flat plate blank, which is sharply folded about a line of symmetry.

18. The apparatus as calimed in claim 1, wherein in the normal plane to the longitudinal direction of the blade the distance between the plane of symmetry and the edge of the blade is less than the dimension of the blade in the plane of symmetry.

19. The apparatus as claimed in claim 1, wherein the blades are mounted such that their effective leading surfaces in the rotational plane of the impeller are within an interval defined by an impeller radius and a backwardly swept line forming 45° with the radius.

20. The apparatus as claimed in claim 1, further comprising a gas heater mounted to feed gas to the impeller region for dispersing the gas into the liquid.

* * * * *